US008984667B1

(12) United States Patent
Parker

(10) Patent No.: US 8,984,667 B1
(45) Date of Patent: Mar. 24, 2015

(54) WATER-REPELLING HAND MITT APPARATUS

(71) Applicant: Scott J. Parker, Viewbank (AU)

(72) Inventor: Scott J. Parker, Viewbank (AU)

( * ) Notice: Subject to any disclaimer, the term of this patent is extended or adjusted under 35 U.S.C. 154(b) by 0 days.

(21) Appl. No.: 14/084,911

(22) Filed: Nov. 20, 2013

(51) Int. Cl.
*A41D 19/01* (2006.01)

(52) U.S. Cl.
CPC ..... *A41D 19/01* (2013.01)
USPC ..... 2/158

(58) Field of Classification Search
USPC ..... 2/158, 159, 164, 161.6, 161.7, 167, 2/168, 169, 161.8, 16, 20, 910; 15/227
See application file for complete search history.

(56) References Cited

U.S. PATENT DOCUMENTS

| | | | | |
|---|---|---|---|---|
| 3,711,889 | A * | 1/1973 | Jennings | 15/227 |
| 4,065,826 | A * | 1/1978 | Hough | 15/227 |
| 4,091,491 | A | 5/1978 | Hoffman | |
| 4,364,142 | A | 12/1982 | Pangle | |
| 4,627,129 | A | 12/1986 | Wittes | |
| 4,787,113 | A | 11/1988 | Kamenske | |
| D361,634 | S | 8/1995 | Swinton | |
| 5,441,355 | A * | 8/1995 | Moore | 401/7 |
| 6,292,948 | B1 * | 9/2001 | Chen | 2/158 |
| 6,305,047 | B1 | 10/2001 | Armaly, Jr. et al. | |
| 6,351,867 | B1 | 3/2002 | Forster | |
| 7,895,768 | B2 | 3/2011 | Vossoughi et al. | |

* cited by examiner

*Primary Examiner* — Tejash Patel

(57) ABSTRACT

A water-repelling hand mitt apparatus removes excess water from a person's hair and body after getting wet. The apparatus includes a flexible hand mitt having a first surface and a second surface. The first surface is water-repellant such that sliding the first surface against a body of a user removes excess water from the user's body. A thumb strap is coupled to the hand mitt and extends over the second surface. A medial portion of the thumb strap is spaced from the second surface such that the thumb strap is configured to receive a thumb of the user when the hand mitt is worn by the user.

20 Claims, 3 Drawing Sheets

WATER-REPELLING HAND MITT APPARATUS

BACKGROUND OF THE DISCLOSURE

1. Field of the Disclosure

The disclosure relates to hand mitt apparatuses and more particularly pertains to a new hand mitt apparatus for removing excess water from a person's hair and body after getting wet.

2. Summary of the Disclosure

An embodiment of the disclosure meets the needs presented above by generally comprising a flexible hand mitt having a first surface and a second surface. The first surface is water-repellant such that sliding the first surface against a body of a user removes excess water from the user's body. A thumb strap is coupled to the hand mitt and extends over the second surface. A medial portion of the thumb strap is spaced from the second surface such that the thumb strap is configured to receive a thumb of the user when the hand mitt is worn by the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
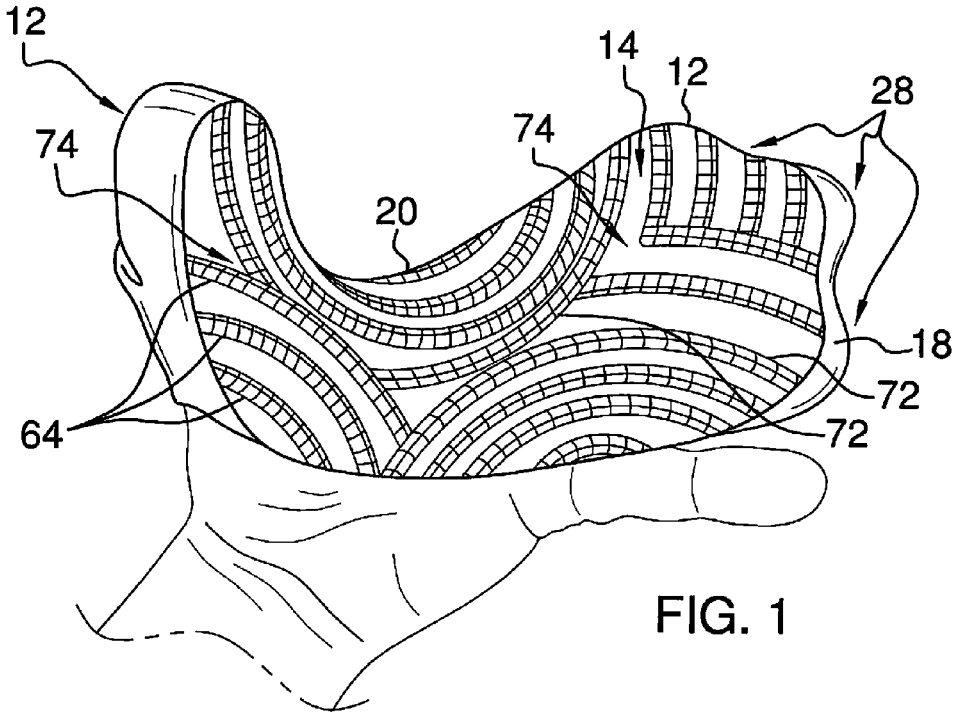
FIG. 1 is a front perspective view of a water-repelling hand mitt apparatus according to an embodiment of the disclosure.
Figure 2:
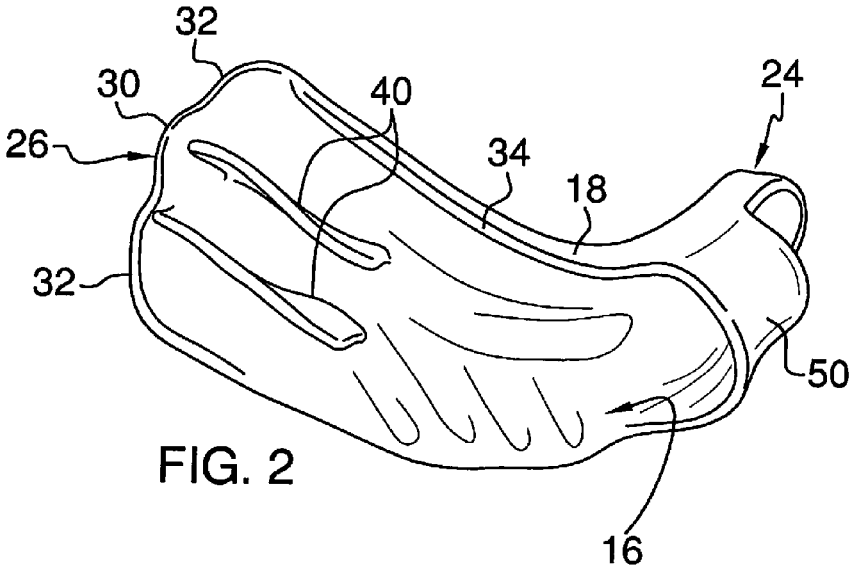
FIG. 2 is a rear perspective view of an embodiment of the disclosure.
Figure 3:
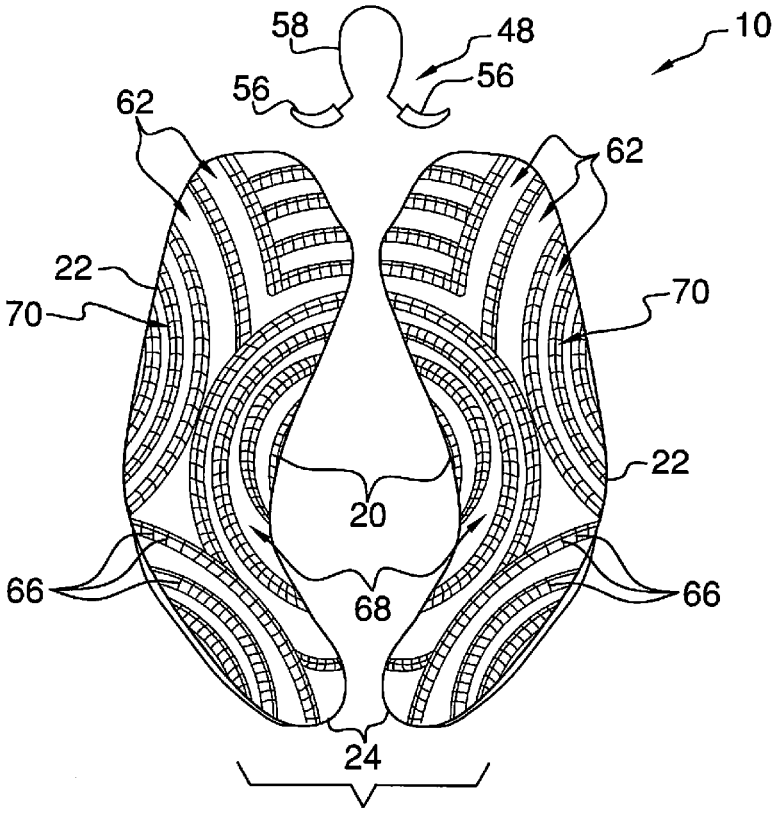
FIG. 3 is a front view of an embodiment of the disclosure.
Figure 4:
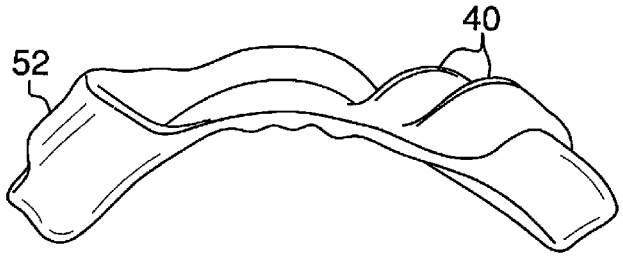
FIG. 4 is a side view of an embodiment of the disclosure.
Figure 5:
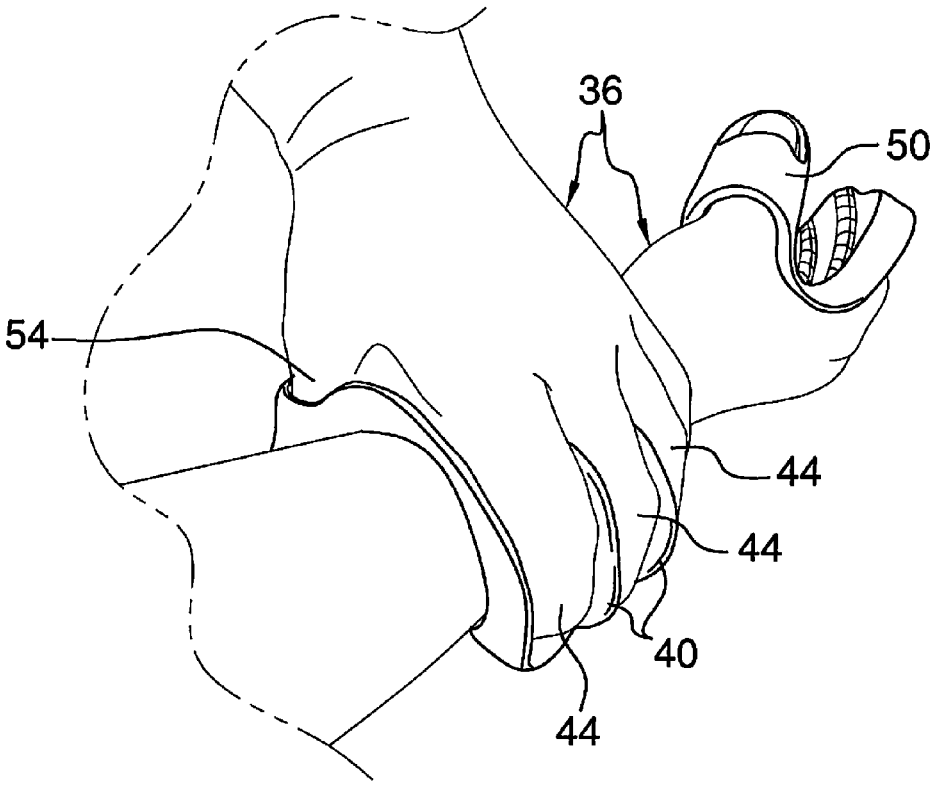
FIG. 5 is an in-use perspective view of a pair of hand mitts of an embodiment of the disclosure.

With reference now to the drawings, and in particular to FIGS. 1 through 5 thereof, a new hand mitt apparatus embodying the principles and concepts of an embodiment of the disclosure and generally designated by the reference numeral 10 will be described.

As best illustrated in FIGS. 1 through 5, the water-repelling hand mitt apparatus 10 generally comprises a flexible hand mitt 12 having a first surface 14, a second surface 16 and a perimeter wall 18 extending between the first surface 14 and the second surface 16. The first surface 14 is water-repellant such that sliding the first surface 14 against a body of a user removes excess water from the user's body. In particular, the first surface 14 may be comprised of an elastomeric material such as silicone rubber or the like. The hand mitt 12 may comprise a pair of hand mitts 12 so that the user can wear one hand mitt 12 on each hand 36. Because both hand mitts 12 are identical, only one hand mitt 12 will be described in detail.

The perimeter wall 18 includes a first lateral side 20, a second lateral side 22, a back side 24 and a front side 26. The first lateral side 20 may be concavely arcuate. Each of the second lateral side 22 and the back side 24 may be convexly arcuate. The front side 26 has a plurality of rounded edges 28. A middle one 30 of the rounded edges 28 extends further away from the back side 24 than each of a pair of outer ones 32 of the rounded edges 28. The perimeter wall 18 further includes an extension 34 that extends outwardly from and is coextensive with the perimeter wall 18. The extension 34 extends toward the second surface 16 and away from the first surface 14. In particular, the extension 34 may extend around the first lateral side 20, the second lateral side 22 and the back side 24.

A pair of spaced dividers 40 is coupled to and extends upwardly from the second surface 16. The dividers 40 are aligned and configured to space apart fingers 44 of the user. The dividers 40 extend in a longitudinal direction across the hand mitt 12 and are positioned proximate the front side 26 of the hand mitt 12. The dividers 40 may be equally spaced between the first 20 and second 22 lateral sides.

A thumb strap 50 is coupled to the hand mitt 12. The thumb strap 50 extends over the second surface 16 between the first 20 and second 22 lateral sides. A medial portion 52 of the thumb strap 50 is spaced from the second surface 16 such that the thumb strap 52 is configured to receive a thumb 54 of the user when the hand mitt 12 is worn by the user. The thumb strap 52 is positioned proximate the back side 24 of the hand mitt 12.

A plurality of slots 62 extends downwardly into the first surface 14 wherein the slots 62 are configured to capture environmental air in order to help repel water from the user's body. The slots 62 extend between the first 20 and second 22 lateral sides and between the front 26 and back 24 sides of the hand mitt 12. A plurality of protrusions 64 extends upwardly from the first surface 14. Each of the protrusions 64 is positioned between an associated one of the slots 62. The protrusions 64 may have a plurality of ridges 66 positioned thereon. Each of the protrusions 64 and the slots 62 may be arcuate. The slots 62 and protrusions 64 form a first group 68 and a second group 70 that each extend between the first lateral side 20 and the second lateral side 22. The first 68 and second 70 groups extend in opposite directions with respect to each other. Each of the first 68 and second 70 groups terminate at a respective outer edge 72 of the associated first 68 and second 70 groups. The outer edges 72 are positioned adjacent to each other. The slots 62 and protrusions 64 are also positioned proximate the front side 26 and the back side 24 and may form v-shaped segments 74 on each of the front side 26 and the back side 24. Each of the slots 62 may have a thickness between approximately 0.1 centimeters and 1.0 centimeters. Each of the protrusions 64 may have a thickness between approximately 0.2 centimeters and 1.2 centimeters.

A mounting apparatus 48 comprises a base portion 58 and at least one mounting hook 56, though preferably a pair of mounting hooks 56 is provided. Each of the mounting hooks 56 is coupled to and extends outwardly from the base portion 58 wherein each of the mounting hooks 56 is configured for supporting an associated one of the hand mitts 12 thereon when the respective thumb strap 50 is positioned on the associated mounting hook 56. Each of the mounting hooks 56 may be arcuate.

In use, as stated above and shown in the Figures, the thumb 54 of the user is slid into the thumb strap 50, while the user's fingers 44 are positioned between the dividers 40. The first surface 14 is then rubbed against hair and body of the user to remove excess water from the user's hair and body. The hand mitt 12 is especially useful after the user has gone swimming or has taken a shower. The ridges 66 allow the hand mitt 12 to comb over body hair of the user. The hand mitt 12 is shaken to remove any water collected in the hand mitt 12. The user may then towel dry his hair and body to complete the drying process. In this manner, less water is soaked into the towel thereby allowing the towel to dry out quicker for subsequent use. The mounting apparatus 48 is used to hang the hand mitts 12 when the hand mitts 12 are not in use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A water-repelling hand mitt apparatus comprising:

a flexible hand mitt having a first surface and a second surface, said first surface being water-repellant such that sliding said first surface against a body of a user removes excess water from the user's body;

a thumb strap coupled to said hand mitt, said thumb strap extending over said second surface, a medial portion of said thumb strap being spaced from said second surface such that said thumb strap is configured to receive a user's thumb when said hand mitt is worn by the user;

a perimeter wall extending between said first surface and said second surface, said perimeter wall including a first lateral side, a second lateral side, a front side and a back side; and an extension extending outwardly from and being coextensive with said perimeter wall, said extension extending toward said second surface and away from said first surface, said extension extending around said first lateral side, said second lateral side and said back side.

2. The apparatus of claim 1, further comprising said first surface being comprised of an elastomeric material.

3. The apparatus of claim 1, further comprising:

a perimeter wall extending between said first surface and said second surface, said perimeter wall including a first lateral side, a second lateral side, a front side and a back side; and wherein said first lateral side is concavely arcuate and each of said second lateral and said back side is convexly arcuate.

4. The apparatus of claim 3, further comprising said front side having a plurality of rounded edges, a middle one of said rounded edges extending further away from said back side than each of an outer one of said rounded edges.

5. The apparatus of claim 1, further comprising a pair of spaced dividers coupled to and extending upwardly from said second surface, said dividers being aligned and configured to space apart fingers of the user, said dividers extending in a longitudinal direction across said hand mitt.

6. The apparatus of claim 1, further comprising said thumb strap extending between a first lateral side and a second lateral side of said hand mitt.

7. The apparatus of claim 1, further comprising said thumb strap being spaced from a back side of said hand mitt.

8. The apparatus of claim 1, further comprising a plurality of slots extending downwardly into said first surface.

9. The apparatus of claim 8, further comprising said slots extending across a first lateral side and a second lateral side of said hand mitt and between a front side and a back side of said hand mitt.

10. The apparatus of claim 8, further comprising a plurality of protrusions extending upwardly from said first surface.

11. The apparatus of claim 10, further comprising each of said protrusions being positioned between an associated one of said slots.

12. The apparatus of claim 10, further comprising each of said protrusions having a plurality of ridges positioned thereon.

13. The apparatus of claim 10, further comprising each of said protrusions and said slots being arcuate.

14. The apparatus of claim 1, further comprising said hand mitt being one of a pair of said hand mitts.

15. The apparatus of claim 1, further comprising a mounting apparatus having a base portion and at least one mounting hook, each said mounting hook being coupled to and extending outwardly from said base portion.

16. The apparatus of claim 15, further comprising each said mounting hook being arcuate.

17. A water-repelling hand mitt apparatus comprising:

a flexible hand mitt having a first surface, a second surface, and a perimeter wall extending between said first surface and said second surface, said perimeter wall including a first lateral side, a second lateral side, a back side and a front side, said first surface being water-repellant such that sliding said first surface against a body of a user removes excess water from the user's body, said first surface being comprised of an elastomeric material, said first lateral side being concavely arcuate, each of said second lateral side and said back side being convexly arcuate, said front side having a plurality of rounded edges, a middle one of said rounded edges extending further away from said back side than each of an outer one of said rounded edges;

an extension extending outwardly from and being coextensive with said perimeter wall, said extension extending toward said second surface and away from said first surface, said extension extending around said first lateral side, said second lateral side and said back side;

a pair of spaced dividers coupled to and extending upwardly from said second surface, said dividers being aligned and configured to space apart fingers of the user, said dividers extending in a longitudinal direction across said hand mitt, said dividers being positioned proximate said front side of said hand mitt, said dividers being equally spaced between said first and second lateral sides;

a thumb strap coupled to said hand mitt, said thumb strap extending over said second surface between said first and second lateral sides, a medial portion of said thumb strap being spaced from said second surface such that said thumb strap is configured to receive a user's thumb when said hand mitt is worn by the user, said thumb strap being positioned proximate said back side of said hand mitt;

a plurality of slots extending downwardly into said first surface, said slots extending between said first and second lateral sides and between said front and back sides of said hand mitt;

a plurality of protrusions extending upwardly from said first surface, each of said protrusions being positioned between an associated one of said slots, said protrusions having a plurality of ridges positioned thereon, each of said protrusions and said slots being arcuate;

wherein said hand mitt is one of a pair of said hand mitts; and a mounting apparatus comprising a base portion and a pair of mounting hooks, each of said mounting hooks being coupled to and extending outwardly from said base portion, each of said mounting hooks being arcuate.

18. A water-repelling hand mitt apparatus comprising:

a flexible hand mitt having a first surface and a second surface, said first surface being water-repellant such that sliding said first surface against a body of a user removes excess water from the user's body;

a thumb strap coupled to said hand mitt, said thumb strap extending over said second surface, a medial portion of said thumb strap being spaced from said second surface such that said thumb strap is configured to receive a user's thumb when said hand mitt is worn by the user; and a plurality of slots extending downwardly into said first surface.

19. The apparatus of claim 18, further comprising said slots extending across a first lateral side and a second lateral side of said hand mitt and between a front side and a back side of said hand mitt.

20. The apparatus of claim 18, further comprising a plurality of protrusions extending upwardly from said first surface.

* * * * *